US006389618B1

(12) United States Patent
Flynn

(10) Patent No.: US 6,389,618 B1
(45) Date of Patent: May 21, 2002

(54) MOVEMENT AID

(76) Inventor: Gilbert John Flynn, 127 Moss Road, South Port, Merseyside, PR8 4JA (GB)

( * ) Notice: Subject to any disclaimer, the term of this patent is extended or adjusted under 35 U.S.C. 154(b) by 0 days.

(21) Appl. No.: 09/426,849

(22) Filed: Oct. 26, 1999

(30) Foreign Application Priority Data

Oct. 27, 1998 (GB) ..... 9823365

(51) Int. Cl.[7] ..... A61G 7/10
(52) U.S. Cl. ..... 5/81.1 R; 5/83.1; 5/85.1
(58) Field of Search ..... 5/81.1 R, 83.1, 5/85.1; 188/38, 62, 33–36; 104/89, 94, 91

(56) References Cited

U.S. PATENT DOCUMENTS

| | | | | | |
|---|---|---|---|---|---|
| 1,188,991 | A | * | 6/1916 | Putnam | 182/15 |
| 3,780,663 | A | * | 12/1973 | Pettit | 104/91 |
| 3,985,082 | A | * | 10/1976 | Barac | 104/91 |
| 4,164,350 | A | | 8/1979 | Zeijdel et al. | |
| 4,545,575 | A | | 10/1985 | Forjot | |
| 4,571,758 | A | | 2/1986 | Samuelsson | |
| 4,576,096 | A | * | 3/1986 | Toder | 104/89 |
| 4,948,118 | A | | 8/1990 | Miraglia | |
| 5,601,434 | A | | 2/1997 | Winters | |

FOREIGN PATENT DOCUMENTS

| | | |
|---|---|---|
| AU | 579 667 | 4/1986 |
| EP | 0 090 711 | 5/1983 |
| EP | 0 128 281 | 12/1984 |
| WO | WO 97/19611 | 6/1997 |

* cited by examiner

*Primary Examiner*—Lynne H. Browne
*Assistant Examiner*—Fredrick Conley
(74) *Attorney, Agent, or Firm*—Olson & Hierl, Ltd.

(57) ABSTRACT

A movement aid suitable for use by disabled persons comprises a track, a trolley moveable along the track, a handle suspended from the trolley and a braking system for controlling and stopping movement of the trolley along the track.

6 Claims, 1 Drawing Sheet

MOVEMENT AID

TECHNICAL FIELD OF THE INVENTION

This invention concerns a movement aid suitable for use by disabled persons, in particular those temporarily or permanently confined to wheelchairs.

BACKGROUND OF THE INVENTION

Electrically operated hoists are available for enabling individuals to lift themselves or to be lifted, but these are not really suitable for enabling general movement from one location to another. For example, present hoists do not provide lateral movement in getting into or out of bed, into and out of a bath, gaining access to a w.c., or getting into or out of a motor vehicle.

An object of this invention is to provide a movement aid suitable for use by disabled persons.

SUMMARY OF THE INVENTION

According to this invention there is provided a movement aid suitable for use by disabled persons comprising a track, a trolley moveable along the track, a handle suspended from the trolley and a braking system for controlling and stopping movement of the trolley along the track.

The track preferably provides a pair of flanges on which are supported wheels or castors of the trolley for movement along the track. The flanges may extend outwards from a beam or may extend inwards from sides of a channel section beam.

The handle is preferably connected to the trolley via a strap, chain or the like and preferably by means of a chain and strap.

The braking system is preferably a caliper braking system, such as of the type provided on bicycles. The calipers are preferably arranged so that brake pads thereon act on the track when the brakes are applied. Operation of the braking system is preferably by means of a brake lever mounted on the handle and connected to the calipers by a wire, cable or the like.

The movement aid of the invention may be used in a variety of situations to enable individuals to lift themselves and to move themselves from place to place when in a wheelchair. For example, the track could be sited for assistance in getting into and out of bed, into and out of a bath, to gain access to a w.c. and for getting into and out of a motor vehicle. The movement aid of the invention could be sited in various public places, such as, for example, spinal injury units, physiotherapy departments, nursing homes, hospital wards and disabled toilets.

This invention will now be further described by way of example only, with reference to the accompanying drawings, in which:

DESCRIPTION OF THE PREFERRED EMBODIMENT

Figure 1:
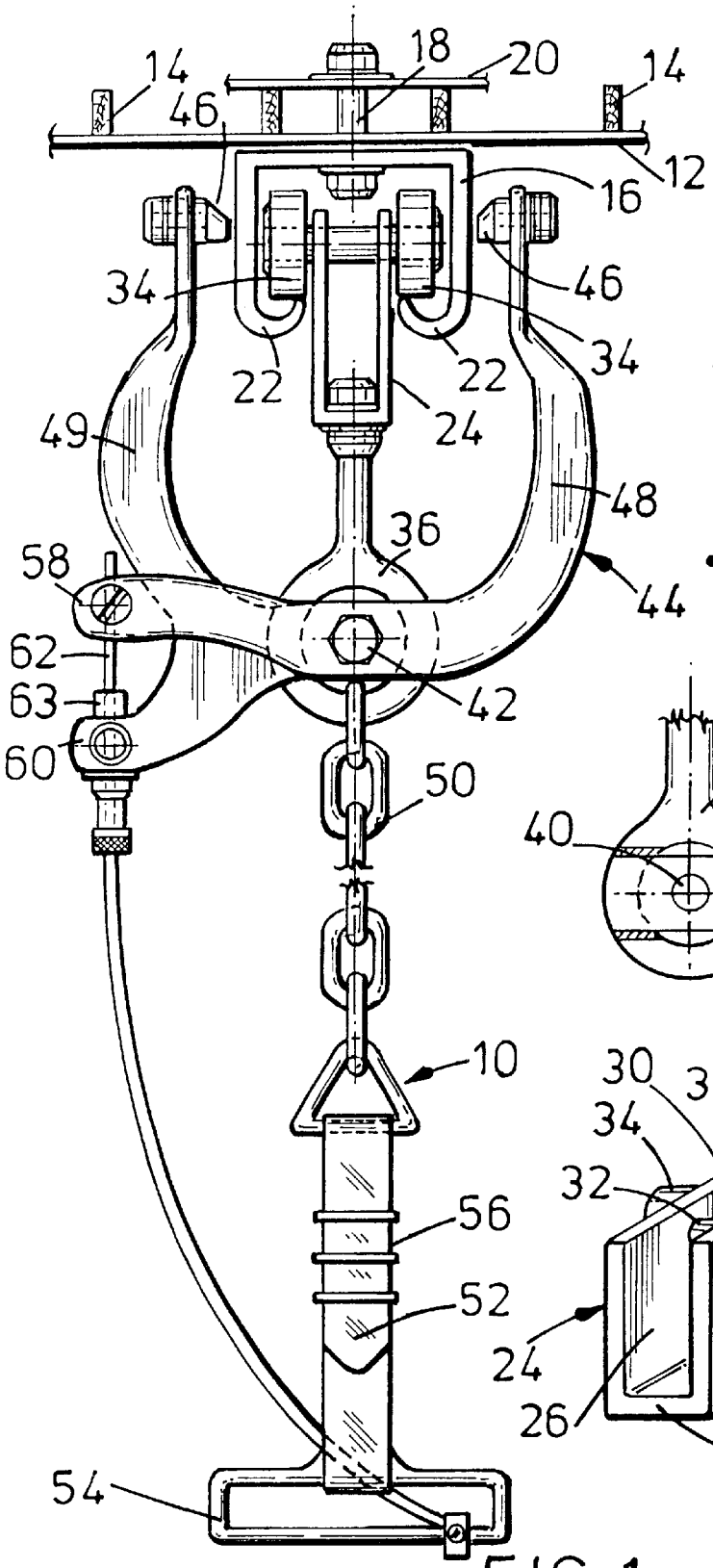
FIG. 1 shows a movement aid mounted to a ceiling.
Figure 3:
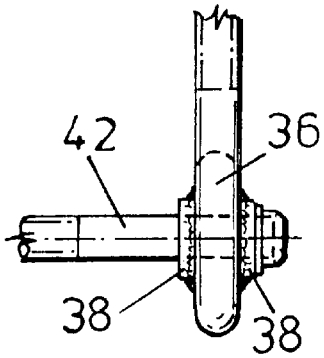
FIG. 3 is a side view of part of the movement aid assembly of FIG. 1.
Figure 4:
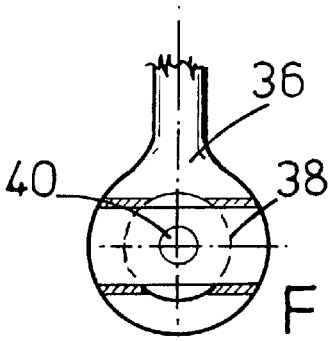
FIG. 4 is a front view of the same part of the movement aid assembly as shown in FIG. 3.
Figure 2:
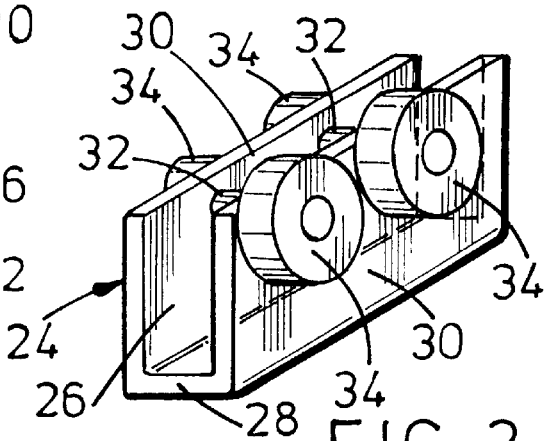
FIG. 2 is an isometric view of a castor for the movement aid of FIG. 1.

Referring to the accompanying drawings, a movement aid 10 for use by disabled persons, by which is meant both those who are permanently or temporarily incapacitated, is shown mounted to a ceiling 12. The ceiling 12 is supported by joists 14 and the joists themselves take the weight of the movement aid.

The lifting aid comprises a track 16 mounted to the ceiling by means of bolts 18 through the track and spreader plates 20 across a pair of adjacent joists 14. The track 16 is a channel section member having inwardly extending flanges 22 on which a trolley 24 travels. The trolley 24 comprises a U-shaped member 26 having a base 28 and sides 30 and a pair of axles 32 through the sides of the member 26 and carrying nylon castors 34 at each end, which run on the flanges 22 of the track 16.

Secured through the base 28 of the U-shaped member 26 is an eye bolt 36. On either side of its "eye", the bolt has welded thereto plates 38 with aligned holes 40 through which is fitted a spindle 42. The spindle 42 carries a caliper brake assembly 44 arranged so that brake pads 46 on upper ends of arms 48, 49 of the caliper brake assembly are positioned to bear on the sides of track 16, when the brake assembly is operated.

The plates 38 are positioned on the eye bolt to leave a gap between their bottom edges and the eye of the eye bolt, so that a support chain 50 can be fixed to the eye bolt. The chain 50 has a length adjustable webbing strap 52 attached to its bottom end and the strap 52 has on its bottom end a handle 54. The webbing strap 52 is provided with a buckle 56 so that its length can be altered to suit the user.

The caliper arms 48, 49 are pivotally mounted on the spindle 42 and their brake ends are biased apart by means of a spring (not shown) on the spindle and acting on both caliper arms. The respective bottom ends 58 and 60 of the arms of the caliper are arranged to be one above the other. The uppermost caliper end 58 is connected to a brake cable 62 and the cable extends through a sleeve 63 in the lowermost caliper arm 60 to a brake lever (not shown) mounted on the handle 54. The brake system is operated by pulling on the brake lever to draw the cable towards the handle and hence pull downwards the caliper end 58, which causes the brake pad of that caliper arm to act on the track side. The spring between the caliper arms equalises the movement of the caliper arms, so that at the same time the brake pad of the other caliper arm is urged onto the opposite side of the track, so that both brake pads exert a braking action to slow down or stop movement of the trolley, and hence of the movement aid along the track.

Thus, the movement aid 10 can be used simply for a person to lift themselves up by pulling on the handle, whilst at the same time operating the brake. On the other hand movement along the track is also possible by flicking the trolley along the track using the chain/strap, then applying the brake and pulling on the handle to move the user along the track. This is particularly useful for those confined to wheelchairs. It is believed that the weight of the chain is important in providing sufficient momentum for the trolley to move along the track but such weight could be provided by other suitable means.

What is claimed is:

1. A movement aid suitable for use by disabled persons comprising in combination:

a track comprising a generally U-configured, elongated channel member having a base and a pair of downwardly extending, transversely spaced, parallel side walls, each side wall having a terminal, in-turned flange portion with a longitudinally extending gap defined between the flange portions;

a trolley moveable along the track, the trolley comprising a U-configured body having a bottom and a pair of upstanding transversely spaced parallel sides, and castors rotatably mounted for longitudinal rolling movement of the trolley with the castors making rolling engagement with inside surface portions of each of the in-turned flange portions, and with portions of the U-configured body being disposed therebetween and within the gap;

a flexible support means suspended from the bottom of the U-configured body of the trolley; and a caliper brake for controlling and stopping movement of the trolley along the track, the caliper brake including a pair of adjacent, curved caliper arms and a supporting spindle that is associated with the bottom, each arm being pivotably mounted at a respective fulcrum region thereof to the spindle, each arm having an upper portion that terminates in opposed relationship to the other on a different opposed outer side portion of each of the track side walls, the caliper brake further including a brake lever, and a brake cable interconnecting the brake lever with one of the caliper arms, the relationship between the track, the trolley and the caliper brake being such that, when the brake lever is operated, each upper arm portion is urged into the respective adjacent outer side portion of each of the track side walls.

2. The movement aid of claim 1 wherein the flexible support means comprises a flexible weighted strap means having a terminal handle means, the relationship between the track, the trolley and the strap means being such that flicking of the strap means by a user can induce movement of the trolley along the track.

3. The movement aid of claim 1 wherein, in the trolley, eye bolt means is connected to, and depends from, the bottom; the flexible support means is suspended from the eye bolt means; and the spindle is connected to the eye bolt means.

4. The movement aid of claim 1 wherein the flexible support means comprises in successive end-to-end combination a chain suspended from the bottom, an adjustable strap connected to the terminus of the chain, and a handle means terminally joined to the adjustable strap.

5. The movement aid of claim 1 where, in the caliper brake, the spindle means laterally extends, the curved configuration of each arm is such that an upper portion of each arm has a terminus located in opposed relationship to the other on a different opposed outer side portion of each of the track side walls while respective lower portions of each arm terminate in superadjacent spaced relationship relative to each other, brake pad means is located at each upper arm portion terminus for engaging each outer side portion of each of the track side walls, spring means biases the upper arm portions apart, the brake lever is mounted on the handle means, and the brake cable is extensible and retractable and extends between the terminus of the uppermost one of the respective lower arm portions and the brake lever and includes sleeve means connected to the lowermost one of the respective lower arm portions through which the brake cable passes.

6. A movement aid suitable for use by disabled persons comprising in combination:

a track comprising a generally U-configured, elongated channel member having a base and a pair of downwardly extending, transversely spaced, parallel side walls, each side wall having a terminal, in-turned flange portion, the flange portions being in generally opposed relationship to each other and being separated from each other by a longitudinally extending gap, the track including means for mounting the base to a superstructure;

a trolley moveable along the track, the trolley comprising:

a U-configured, elongated body having a bottom and a pair of upstanding transversely spaced parallel sides, and castors, and castor-associated, body-connected axle means for rotatably mounting the castors along outside portions of the sides, for longitudinal rolling movement of the trolley, the relationship between the track and the trolley being such that the castors make rolling engagement with inside surface portions of each of the in-turned flange portions with portions of the U-configured body being disposed therebetween and within the gap;

the trolley further having eye bolt means connected to and depending from the bottom;

a flexible weighted strap means suspended from the eye bolt means and having a terminal handle means; and a caliper brake for controlling and stopping movement of the trolley along the track, the caliper brake comprising:

a laterally extending spindle means connected to the eyebolt means, a pair of adjacent, curved caliper arms, each arm being pivotably mounted at a respective fulcrum region thereof to the spindle means, each arm having upper and lower arm portions, each upper arm portion having a terminus located in generally horizontally opposed relationship relative to the other on a different opposed outer side portion of each of the track side walls, and each said lower arm portion terminating in superadjacent, generally vertically spaced relationship relative to the other, brake pad means at each upper arm portion terminus for engaging each outer side portion of each of the track side walls, spring means biasing the upper arm portions apart, a brake lever mounted on the handle means, and extensible and retractable brake cable means extending between the terminus of the uppermost one of the respective lower arm portions and the brake lever and including sleeve means connected to the lowermost one of the respective lower arm portions through which the brake cable means slidably passes, the relationship between the track, the trolley, the strap means and the caliper brake being such that when the strap means is flicked by a user, movement of the trolley along the track can occur, and when the brake lever is operated by a user, each upper arm portion is urged into the respective adjacent outer side portion of each of the side track walls, thereby braking movement of the trolley along the track.

* * * * *